US008746584B2

(12) United States Patent
Helt

(10) Patent No.: US 8,746,584 B2
(45) Date of Patent: Jun. 10, 2014

(54) HEATER INTERLOCK CONTROL FOR AIR CONDITIONING SYSTEM

(75) Inventor: Robert W. Helt, Tyler, TX (US)

(73) Assignee: Trance International Inc., Piscataway, NJ (US)

( * ) Notice: Subject to any disclaimer, the term of this patent is extended or adjusted under 35 U.S.C. 154(b) by 2173 days.

(21) Appl. No.: 11/728,632

(22) Filed: Mar. 27, 2007

(65) Prior Publication Data

US 2008/0237217 A1 Oct. 2, 2008

(51) Int. Cl.
*F24H 3/04* (2006.01)

(52) U.S. Cl.
USPC ..... 237/2 A; 392/335; 165/240; 219/475; 219/489; 219/490; 219/494; 219/495

(58) Field of Classification Search
USPC ..... 237/2 A; 392/335; 165/240; 136/246; 219/475, 489, 490, 494, 495, 496
See application file for complete search history.

(56) References Cited

U.S. PATENT DOCUMENTS 1,510,169 A * 9/1924 Aikman ..... 417/12
1,991,280 A * 2/1935 Hynes ..... 392/349
2,210,852 A * 8/1940 Falkenberg ..... 431/30
2,212,239 A * 8/1940 Komroff et al. ..... 165/222
2,934,323 A * 4/1960 Burke ..... 165/240
2,937,803 A * 5/1960 Cunningham ..... 417/420
2,953,355 A * 9/1960 Hungate ..... 165/229
3,540,526 A * 11/1970 Kautz et al. ..... 165/216
3,912,162 A * 10/1975 Bauer et al. ..... 236/11
4,307,775 A * 12/1981 Saunders et al. ..... 165/240
4,329,138 A 5/1982 Riordan
4,373,662 A * 2/1983 Bassett et al. ..... 236/10
4,421,268 A * 12/1983 Bassett et al. ..... 236/10
4,474,227 A * 10/1984 Reedy ..... 237/2 A
4,476,920 A * 10/1984 Drucker et al. ..... 237/2 B
4,518,116 A * 5/1985 Grant ..... 236/1 B
4,648,551 A * 3/1987 Thompson et al. ..... 165/300
4,688,547 A * 8/1987 Ballard et al. ..... 237/2 A
4,845,341 A * 7/1989 Rae ..... 219/497
4,896,828 A * 1/1990 Peitz, Jr. ..... 700/82
5,337,574 A * 8/1994 Dick ..... 165/244
5,397,970 A * 3/1995 Rowlette et al. ..... 318/400.09

(Continued)

FOREIGN PATENT DOCUMENTS

JP 2003163069 A * 6/2003 ..... H05B 3/00

OTHER PUBLICATIONS

Siskind, Charles S., Electrical Control Systems in Industry, 1963, McGraw-Hill, p. 2.*

(Continued)

*Primary Examiner* — Kang Hu
*Assistant Examiner* — Phillip E Decker
(74) *Attorney, Agent, or Firm* — Conley Rose, P.C.; Alan Dawson Lightfoot; J. Robert Brown, Jr.

(57) ABSTRACT

An air conditioning apparatus, including an electric motor driven blower for circulating air through a cabinet, also includes one or more electric heating elements and a system controller operable to control energization of the heating elements and the blower motor at predetermined operating conditions by way of suitable relay or control elements. The system includes a heating interlock relay to prevent energization of the one or more heating elements if the blower motor is inoperable, operating at other than a predetermined range of speeds or the system controller detects a malfunctioning heating element control relay or the like.

21 Claims, 2 Drawing Sheets

(56) References Cited

U.S. PATENT DOCUMENTS

| | | | | |
|---|---|---|---|---|
| 5,488,218 | A * | 1/1996 | Olsen et al. | 219/492 |
| 5,619,112 | A * | 4/1997 | Younessi et al. | 318/689 |
| 6,089,310 | A * | 7/2000 | Toth et al. | 165/11.1 |
| 6,326,930 | B1 * | 12/2001 | Jones | 392/422 |
| 6,353,303 | B1 * | 3/2002 | Ramachandran et al. | 454/229 |
| 6,423,118 | B1 * | 7/2002 | Becerra et al. | 95/19 |
| 6,925,999 | B2 * | 8/2005 | Hugghins et al. | 126/116 A |
| 7,161,316 | B2 * | 1/2007 | Archer et al. | 318/432 |
| 7,177,534 | B2 * | 2/2007 | Jones et al. | 392/360 |
| 7,332,019 | B2 * | 2/2008 | Bias et al. | 96/15 |
| 7,381,028 | B2 * | 6/2008 | Hancock et al. | 415/214.1 |
| 7,434,744 | B2 * | 10/2008 | Garozzo et al. | 700/276 |
| 7,601,204 | B2 * | 10/2009 | Woodruff et al. | 96/30 |
| 2005/0006488 | A1 * | 1/2005 | Stanimirovic | 236/49.1 |
| 2005/0082277 | A1 * | 4/2005 | Jones et al. | 219/494 |
| 2005/0258259 | A1 * | 11/2005 | Stanimirovic | 236/49.1 |
| 2006/0049268 | A1 * | 3/2006 | Weimer et al. | 236/51 |
| 2006/0130663 | A1 * | 6/2006 | Joshi et al. | 96/224 |
| 2006/0185373 | A1 * | 8/2006 | Butler et al. | 62/181 |
| 2008/0223944 | A1 * | 9/2008 | Helt et al. | 236/51 |
| 2009/0090115 | A1 * | 4/2009 | Boydstun et al. | 62/126 |
| 2011/0073159 | A1 * | 3/2011 | Shen et al. | 165/104.31 |

OTHER PUBLICATIONS

Korea ElectroTechnology Research Institute, KR 1019940000136 English abstract, Jul. 1, 1994.*

* cited by examiner

HEATER INTERLOCK CONTROL FOR AIR CONDITIONING SYSTEM

BACKGROUND OF THE INVENTION

In certain types of heating, ventilating and air conditioning (HVAC) equipment, electric heating elements are incorporated in the equipment in combination with a motor driven blower and, possibly, a cooling type heat exchanger, such as an evaporator coil for a vapor compression cooling circuit or heat pump circuit. One problem associated with utilizing electric heating elements in an air conditioning system of the general type mentioned herein is the requirement to provide for positive shut-off of the electric heating elements if the system blower or air circulation fan motor is operating in a range of operating conditions which will result in hazardous heat buildup. For example, if the blower or circuiting fan motor is operating at a relatively low speed, or has shut-off for any reason, unwanted and rapid heat buildup or overheating of the system may occur.

Moreover, regulatory requirements for air conditioning systems which utilize electric heating elements can result in extensive testing for various blower or air circulating fan motor operating conditions. However, if a system control can be provided which would block or interrupt power to the electric heating elements when the blower or circulating fan motor was operating outside of a predetermined range of operating conditions, regulatory testing requirements could be reduced, system reliability increased and the chance of a hazardous operating condition could be avoided. It is to these ends that the present invention has been developed.

SUMMARY OF THE INVENTION

The present invention provides improved controls for an air conditioning system of a type which includes electric heating elements and one of several selected types of blower or air circulating fan electric drive motors whereby the electric heating elements are prevented from operation under certain motor operating conditions. For example, if the blower motor is operating at a speed less than a predetermined speed an interlock or relay is actuated which will be prevent operation of the electric heating element or elements. Still further, if the blower drive motor should fail, power to such heating elements would also be locked out or interrupted by the control system of the invention.

The present invention further provides a method for operating an air conditioning system utilizing electric heating elements and one of a selected type of blower or circulating fan drive motor wherein, depending on the control signals imposed on the motor control system, or a signal from the motor control system, a so-called interlock relay is actuated to prevent energization of the electric heaters. Still further, for applications of air conditioning equipment with variable speed motors driving an air circulation fan or blower, electric heater operation may be inhibited at a predetermined maximum blower speed in the event of a restricted air inlet to or air outlet from the system cabinet.

Those skilled in the art will further appreciate the above-mentioned advantages and features of the invention, together with other important aspects thereof upon reading the detailed description which follows in conjunction with a drawing.

DETAILED DESCRIPTION OF THE PREFERRED EMBODIMENTS

Figure 1:
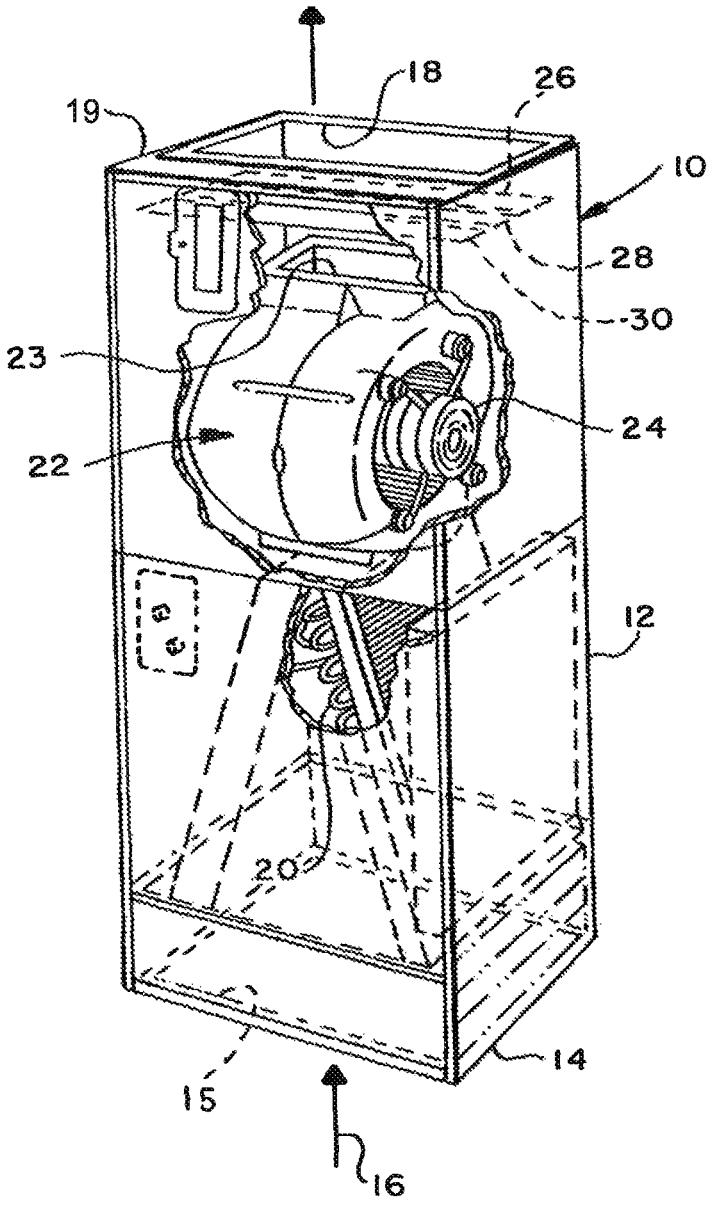
FIG. 1 is perspective view of an air conditioning apparatus utilizing a control system and method in accordance with the invention.

In the description which follows, like parts are marked throughout the specification and drawing with the same reference numerals, respectively. The drawing figures and elements thereof may be in somewhat generalized or schematic form in the interest of clarity and conciseness.

Referring to FIG. 1, there is illustrated an air conditioning apparatus 10, commonly known in the art as an air handler. The apparatus 10 comprises a substantially rectangular hollow cabinet 12 and is arranged as an upflow type apparatus wherein a bottom wall 14 of the cabinet 12 has a suitable large opening 15, see FIG. 2 also, to allow air flow in a generally upward direction, as indicated by arrow 16. Air flows from bottom wall 14 upwardly and out through an opening 18 in a transverse top wall 19.

Within cabinet 12 there is disposed a suitable heat exchanger, such as an air conditioning or cooling coil 20, disposed between the aforementioned air inlet opening and an air circulating fan or blower 22. Blower 22 is driven by a suitable electric motor 24 which may be controlled in accordance with description that follows herein and in accordance with the invention. Air conditioning apparatus 10 also includes additional heat exchangers or heating means comprising electric resistance grid type heaters or heating elements 26, 28 and 30 which are illustrated three in number by way of example. One or more electric heaters may be utilized in an air conditioning control system and method in accordance with the invention. Electric heaters 26, 28 and 30 are disposed between an outlet opening 23 of blower 22 and the cabinet air outlet opening 18, FIG. 1

In the manufacture of air handlers or air conditioning apparatus of the general type illustrated and described, various types of blower drive motors may be utilized, including variable speed motors with serial communication, that is, communication between the blower motor and a controller may be by way of a four-wire interface and the air handler controller may include a microprocessor which will signal the desired blower speed required to satisfy the demand for conditioned air flowing through the cabinet 12 to an enclosed space. The motor 24 may also be a so-called constant torque type motor whereby the aforementioned controller may be set to select a constant torque setting from a plurality of available settings. The aforementioned air handler controller typically provides a suitable signal to the desired motor input connection. Still further, the motor 24 may be a so-called PSC (permanent split capacitor) motor whereby the controller may select one of three motor speeds and provide a signal for controlling the operation of one or more relays.

Figure 2:
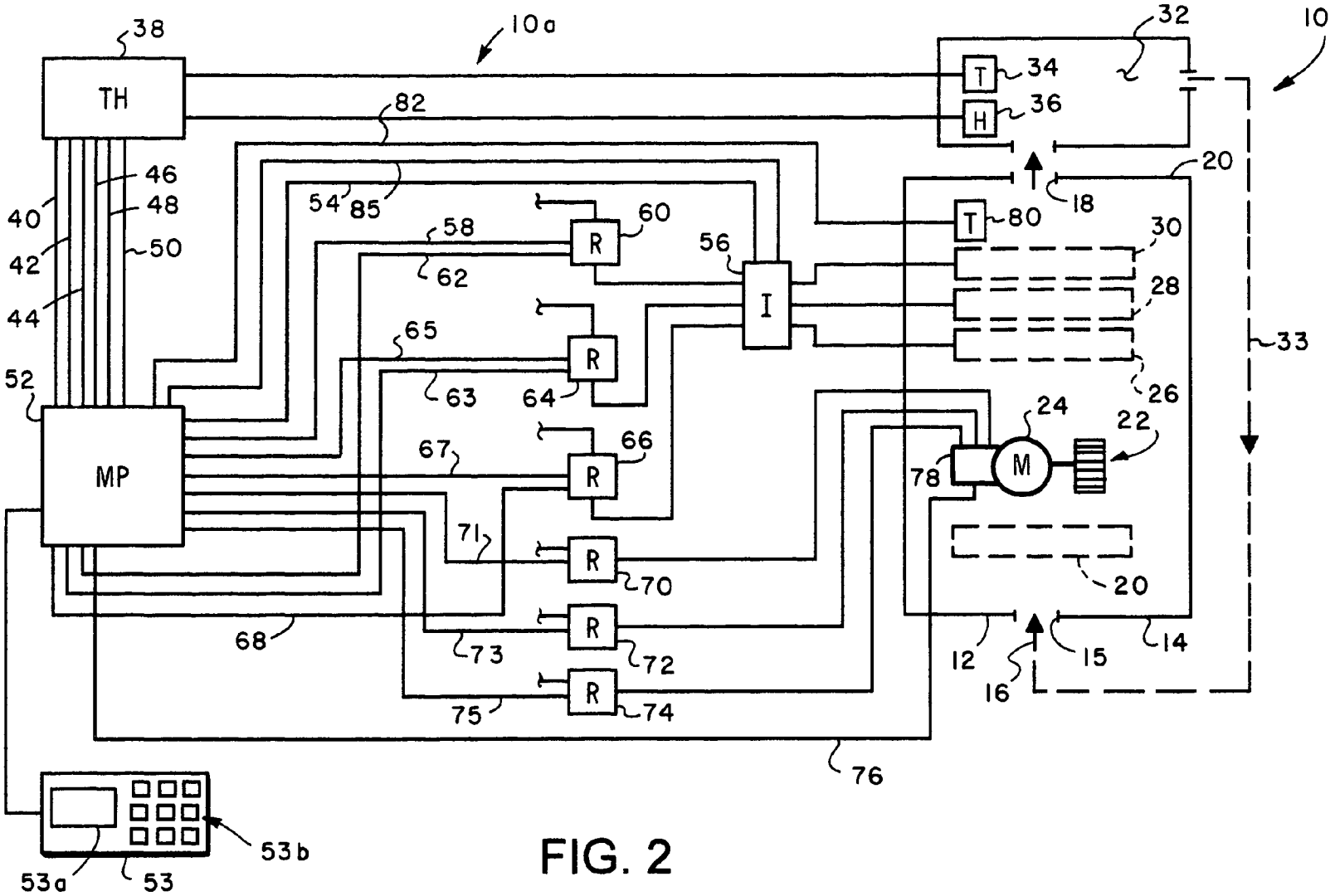
FIG. 2 is schematic diagram illustrating major components of a control system in accordance with the invention.

Referring now to FIG. 2, the apparatus 10 is illustrated somewhat schematically and associated with a control system 10*a* for providing conditioned air to an enclosed space 32 from which conditioned air may be returned to the apparatus 10 via suitable duct means, as indicated by the dashed line 33. A temperature sensor 34 and a humidity sensor 36 may be disposed in the air conditioned space 32 and suitably connected to a thermostat control device 38 which is provided with low voltage power in a conventional manner. Thermostat 38 may also provide output signals via respective conductors, including a first stage heating output signal via conductor 40, a second stage heating output signal via a conductor 42, a third stage heating output signal via a conductor 44, at least a first cooling stage output signal via a conductor 46, a continuous fan operating mode signal via a conductor 48 and, possibly, a heat pump operating signal via a conductor 50. Alternatively, serial or parallel digital communication signals may be sent between thermostat 38 and a controller described hereinbelow. The control system 10*a* and apparatus 10 illustrated in FIG. 2 would, typically, include a vapor compression compressor and condenser unit, not shown, operably connected to the evaporator or cooling coil 20 and configured for either cooling only or, possibly, heat pump operation. The output signals conducted from thermostat 38 are input to a microcontroller for the system 10*a*, generally designated by the numeral 52. Microcontroller 52 may be of a type commercially available, such as a Model AT Mega 128 commercially available from Atmel Corporation, San Jose, Calif. A suitable human operable interface 53 including a visual display 53*a* and control and/or configuration command input means 53*b* may also be operably connected to microcontroller 52. Microcontroller 52 is provided with suitable electric power from a source which may also supply power to the thermostat 38, but not shown in the drawing, such a source being well known to those skilled in the art.

Referring further to FIG. 2, microcontroller 52 provides output signals by way of respective conductors as follows. Conductor 54 provides a heater interlock relay signal to a heater interlock relay 56. Output signal conductor 58 provides a control signal to a heater relay 60 connected to heater 30 by way of the relay 56. A status signal indicating the condition of relay 60 may be input to microcontroller 52 via conductor means 62.

In like manner, second and third stage heaters 28 and 26 are operably connected to respective relays 64 and 66 which receive control signals from the microcontroller 52 by way of conductors 65 and 67, respectively. Relay status signals are returned to the microcontroller by way of conductors 63 and 68, as indicated. Assuming that a PSC type motor is the embodiment of the motor 24 shown in FIG. 2, suitable motor control relays 70, 72 and 74 may be provided with control signals by way of conductors 71, 73 and 75 whereby the microcontroller 52 may command operation of the blower motor 24 at selected speeds. An input signal to the microcontroller 52 may be provided by way of a conductor 76 which is connected to a motor controller 78 which also receives operating signals from the relays 70, 72 and 74 for operating the motor 24 at the selected speed.

Although the specific configuration of the motor control circuit 78 and the associated relays 70, 72, and 74 illustrated in FIG. 2 may be that for a PSC motor, control signals on conductors 71, 73 and 75 may be sent directly to motor controller 78 to set a motor speed control signal or a motor torque control signal commensurate with the air flow demand for the conditions which exist as determined by the sensors 34 and/or 36, for example. The microcontroller 52 may, for example, issue a message to the blower motor controller 78 to set the control mode and receive a status signal of motor speed in return, set motor speed and receive a torque signal, set motor torque and request a demand signal, set air flow demand and request direction of rotation of the blower motor, set demand ramp time and request status of the demand ramp rate, set motor torque percent and request status regarding the air flow limit, and set blower coefficients. Air flow limits may also be set by the microcontroller 52 via the motor controller 78, for example.

The system 10*a* may be preset to operate in the selected mode depending somewhat on the type of motor 24 being used and including the types of motors described hereinbefore. However, for variable speed motors and variable torque motors certain limits are required to be set within and controlled by the microcontroller 52. For motor speeds above and below the preset limit speeds, for example, the heaters or heating elements 26, 28 and 30 are not allowed to operate. For example, if the motor 24 is not energized the controller 52 will send a signal to the heater interlock 56 to prevent conducting electrical power to the heating elements 26, 28 and 30, even if any one of relays 60, 64 or 66 is closed. Still further, if the motor 24 is not operating the blower 22 at a predetermined minimum speed sufficient to provide a certain volume rate of airflow through the cabinet 12, one or all of the heating elements 26, 28 and 30 will be prevented from operation by actuation of the interlock 56. Also, blower motor speed is continuously monitored and, if an overspeed condition exists, possibly indicating blockage of air flow into or out of cabinet 12, the interlock relay 56 may also be operated to shutoff power to the heating elements 26, 28 and 30. Still further, the status of the heaters 26, 28 and 30 may be confirmed by the status of the respective relays 66, 64 and 60. Additionally, a temperature sensor 80 may be disposed in cabinet 12 to measure system discharge air temperature from apparatus 10 and communicate a signal regarding same to microcontroller 52 by way of conductor means 82. Microcontroller 52 may be programmed such that system discharge air temperature in excess of a predetermined value, or the rate of change of discharge air temperature in excess of a predetermined value, may be effective to cause microcontroller 52 to shut off operation of the heating elements 26, 28 and 30. Such shutoff of heating elements 26, 28 and 30 may be carried out by actuation of the respective relays 66, 64 and 60 or by the interlock 56 if any one of the relays should fail.

Accordingly, a signal from the motor 24 and/or its controller 78 to microcontroller 52 determines the status of the motor, that is, energized at a selected speed or selected torque setting or deenergized. The heater power relays 60, 64 and 66 also transmit signals or otherwise communicate to the microcontroller 52 indicating their status, that is, for example, stuck or failed open, actuated to allow power to flow to the respective heating elements 26, 28 and 30 and the contact elements welded or stuck together to prevent opening a power circuit between a power source, not shown, and the respective heating elements. Still further, the interlock 56 may communicate its status via a conductor 85 to microcontroller 52 to indicate whether it is in a condition to prevent power being applied to the heating elements 26, 28 or 30 or vice versa.

If the thermostat 38 issues a call for heating, signals are sent via conductors 40, 42 or 44, or possibly all three, which will cause microprocessor 52 to transmit a signal to motor controller 78, possibly via relays 70, 72 and 74, to energize motor 24 at a selected speed. Typically, there are no on or off delays in energizing the motor 24 with respect to the signals sent to the relays 60, 64 and 66 to energize one or more of the heaters 26, 28 and 30. However, if more than one stage of electric heat demand is called by thermostat 38, relays 60, 64 and 66 may be energized at intervals of about 0.5 seconds, respectively. If a signal is presented to the controller 52 only at conductor 40, motor 24 may be energized for about 0.5 seconds before interlock relay 56 is closed to allow energization of the selected heating element, for example. A similar delay in signal transmission may be carried out when the call for heat has been satisfied to enable capture or transmission of residual heat from the heating elements to the circulating air.

Other modes of operation may include operation when a signal is provided on conductor 48 for continuous operation of the motor 24 and a combination of the electric heating and heat pump operation in the heating mode is initiated wherein the microcontroller 52 will effect energization of the respective heating elements and provide for operation of the heat exchanger 20 to reject heat. The controller 52 will recognize that this mode of operation requires operation of the blower 22 at the higher of the electric heat or so-called mechanical heat air flow requirements, immediately. The controller 52 is also capable of detecting a fault condition in heater interlock 56. If the heater interlock relay feedback signal via conductor 85 indicates the interlock relay contacts are closed when they should be open or if any of the relays 60, 64 and 66 signal the controller 52 that the relay contacts are closed when they should be open, such signals will cause the controller 52 to run the blower motor 24 at maximum heat speed and report a fault condition via the interface 53. Moreover, if the interlock relay 56 is stuck closed, the microcontroller 52 may ignore requests for heating, for example. Still further, anytime the microcontroller 52 should malfunction and denergize the blower motor 24, the heater interlock relay 56 is also required to interrupt power to the heating elements or heaters 26, 28 and 30.

The construction and operation of control system 10*a* for an air conditioning system in accordance with the invention is believed to be within the purview of one skilled in the art based on the foregoing description. Commercially available components may be utilized to provide the functions described herein. Although preferred embodiments of the invention have been described in detail, those skilled in the art will recognize that various substitutions and modifications may be made without departing from the scope and spirit of the appended claims.

What is claimed is:

1. An air conditioning system comprising:

an air blower including an electric blower motor for propelling air from an air inlet in a cabinet to an air outlet;

at least one electric heating element disposed in an air flowstream propelled by said air blower through said cabinet;

a heater interlock operatively connected to said at least one electric heating element and operable to control energization thereof;

at least one heater relay in communication with said heater interlock; and a system controller operable to communicate control signals for controlling operation of one or more components of the air conditioning system, said control signals being based on status signals indicative of one or more operating conditions corresponding to at least one of said air blower, said at least one electric heating element, said heater interlock, and said at least one heater relay, wherein said status signals include fault signals indicative of faulty operating conditions associated with at least one of said heater interlock or said at least one heater relay;

wherein said system controller communicates a control signal instructing said heater interlock to prevent energization of said at least one electric heating element in response to occurrence of both (1) receiving a status signal indicating said electric blower motor is operating at a speed outside a predetermined range of speeds and (2) said at least one heater relay indicating a faulty operating condition.

2. The system set forth in claim 1, wherein said system controller is operatively connected to said at least one heater relay, said at least one heater relay being operable to control supply of electrical power to said at least one electric heating element, and wherein said heater interlock is interposed between said at least one electric heating element and said at least one heater relay.

3. The system set forth in claim 2, wherein said air blower includes a motor controller for controlling said electric blower motor, and wherein said system controller is operable to communicate command signals instructing said motor controller to operate said electric blower motor in conditions based on said status signals.

4. The system set forth in claim 3, wherein, upon receiving a fault signal indicating any one of said at least one heater relay and said heater interlock has malfunctioned, said system controller is operable to communicate a command signal instructing said motor controller to operate said electric blower motor in a predetermined direction and at a predetermined speed.

5. The system set forth in claim 4, wherein at least one of said at least one heater relay and said heater interlock is operable to communicate said fault signal to said system controller.

6. The system set forth in claim 3, wherein said electric blower motor is a permanent split capacitor (PSC) motor, and wherein said system controller is operable to communicate a command signal instructing said motor controller to select a motor speed for operating said electric blower motor, said motor speed being selected from a plurality of motor speeds.

7. The system set forth in claim 3, wherein said electric blower motor is a constant torque motor, and wherein said system controller is operable to communicate a command signal instructing said motor controller to select a constant torque setting for said electric blower motor, said constant torque setting being selected from a plurality of torque settings.

8. The system set forth in claim 3, wherein, upon receiving a fault signal indicating said heater interlock is operating in a faulty condition, said system controller communicates a command signal instructing said motor controller to operate said electric blower motor at a predetermined maximum speed.

9. The system set forth in claim 1, wherein said electric blower motor is a variable speed motor.

10. The system set forth in claim 9, wherein, upon receiving a status signal indicating said variable speed motor is operating at a speed lesser or greater than a predetermined amount, said system controller communicates a control signal instructing said heater interlock to prevent energization of said at least one electric heating element.

11. The system set forth in claim 1, wherein, upon receiving a status signal indicating said electric blower motor is operating at a speed greater than a predetermined maximum speed, said system controller communicates a control signal instructing said heater interlock to prevent energization of said at least one electric heating element.

12. A heating, ventilating, and air conditioning (HVAC) system for controlling electrical heating elements in accordance with fan operating conditions, the system comprising:

an air conditioning apparatus including a cabinet, a fan operatively connected to the air conditioning apparatus, the fan including a motor for propelling air from an air inlet in the cabinet to an air outlet;

a heat exchanger disposed within the cabinet between the air inlet and the fan; a plurality of electrical heating elements disposed in an airflow propelled by the fan through the cabinet;

a thermostat for sensing temperature of an enclosed space being supplied with air conditioned by the HVAC system;

a heater interlock operatively connected to the plurality of electrical heating elements and operable to control electrical power supplied thereto;

one or more relays in communication with the plurality of electrical heating elements and the heater interlock;

a controller operable to communicate signals for controlling operation of the HVAC system, the signals being based on status signals indicative of operating conditions associated with one or more components of the HVAC system, wherein said status signals include fault signals indicative of faulty operating conditions associated with at least one of said heater interlock or said one or more relays;

wherein, upon receiving a status signal indicating the motor is operatively running above or below a maximum or a minimum speed, respectively, the controller communicates a shutoff signal instructing the heater interlock to prevent electrical power from being supplied to at least one electrical heating element selected from the plurality of electrical heating elements; and wherein, upon receiving a status signal indicating a rate of change in an air discharge temperature exceeding a predetermined value, the controller communicates a shutoff signal instructing one of, the heater interlock or at least one relay of the plurality of relays, to prevent electrical power from being supplied to at least one electrical heating element of the plurality of electrical heating elements.

13. The system of claim 12, wherein, upon receiving a status signal indicating the motor is not operating, the controller communicates a shutoff signal instructing the heater interlock to prevent electrical power from being supplied to each electrical heating element of the plurality of electrical heating elements.

14. The system of claim 12, wherein, upon receiving a status signal indicating the motor is not operating at or above a predetermined speed necessary for propelling air at a predetermined rate, the controller communicates a shutoff signal instructing the heater interlock to prevent electrical power from being supplied to at least one electrical heating element selected from the plurality of electrical heating elements.

15. The system of claim 12, wherein motor operating speed is continuously monitored.

16. The system of claim 15, wherein, upon receiving a status signal indicative of an airflow blockage through the cabinet, the controller communicates a shutoff signal instructing the heater interlock to prevent electrical power from being supplied to at least one electrical heating element selected from the plurality of electrical heating elements.

17. The system of claim 12, wherein, upon receiving a status signal indicating an air discharge temperature exceeding a predetermined value, the controller communicates a shutoff signal instructing the heater interlock to prevent electrical power from being supplied to at least one electrical heating element selected from the plurality of electrical heating elements.

18. The system of claim 12, wherein, upon a controller malfunction and the motor being de-energized, the heater interlock automatically prevents electrical power from being supplied to the plurality of electrical heating elements.

19. The system of claim 12, wherein upon receiving a status signal indicating the motor is not rotating in a specified direction, the controller communicates a shutoff signal instructing the heater interlock to prevent electrical power from being supplied to the plurality of electrical heating elements.

20. The system of claim 12, wherein, upon receiving a signal for a combined mode of operation, the controller communicates at least one control signal for effectuating the combined mode of operation, and wherein the combined mode of operation includes continuous operation of the motor, energization of the plurality of electrical heating elements, and operation of the heat exchanger to reject heat.

21. A heating, ventilating, and air conditioning (HVAC) system for controlling electrical heating elements in accordance with fan operating conditions, the system comprising:

an air conditioning apparatus including a cabinet, a fan operatively connected to the air conditioning apparatus, the fan including a motor for propelling air from an air inlet in the cabinet to an air outlet;

a heat exchanger disposed within the cabinet between the air inlet and the fan;

a plurality of electrical heating elements disposed in an airflow propelled by the fan through the cabinet;

a thermostat for sensing temperature of an enclosed space being supplied with air conditioned by the HVAC system;

a heater interlock operatively connected to the plurality of electrical heating elements and operable to control electrical power supplied thereto;

one or more relays in communication with the plurality of electrical heating elements and the heater interlock;

a controller operable to communicate signals for controlling operation of the HVAC system, the signals being based on status signals indicative of operating conditions associated with one or more components of the HVAC system, wherein said status signals include fault signals indicative of faulty operating conditions associated with at least one of said heater interlock or said one or more relays;

wherein, upon receiving a status signal indicating the motor is operatively running above or below a maximum or a minimum speed, respectively, the controller communicates a shutoff signal instructing the heater interlock to prevent electrical power from being supplied to at least one electrical heating element selected from the plurality of electrical heating elements; and wherein the HVAC system further comprises one or more relay contacts associated with at least one of the heater interlock and one of the one or more relays, respectively, wherein, upon receiving a status signal indicating one of the one or more relay contacts is improperly open or closed, the controller communicates a command signal for operating the motor at a maximum heat speed.

* * * * *

UNITED STATES PATENT AND TRADEMARK OFFICE

CERTIFICATE OF CORRECTION

PATENT NO. : 8,746,584 B2
APPLICATION NO. : 11/728632
DATED : June 10, 2014
INVENTOR(S) : Robert W. Helt It is certified that error appears in the above-identified patent and that said Letters Patent is hereby corrected as shown below:

Title Page:

(73) Assignee should read:

Trane International Inc., Piscataway, NJ (US)

Signed and Sealed this
Fourteenth Day of October, 2014

Michelle K. Lee

Michelle K. Lee
*Deputy Director of the United States Patent and Trademark Office*